US011889956B2

(12) United States Patent
Rafael et al.

(10) Patent No.: US 11,889,956 B2
(45) Date of Patent: Feb. 6, 2024

(54) HAND DRYER

(71) Applicant: 3 GREEN EVER INTERNATIONAL INC LTD, Nicosia (CY)

(72) Inventors: Sitjar Cañellas Rafael, Hünenberg (CH); Canut Cristobal Miguel, Hünenberg (CH)

(73) Assignee: 3 GREEN EVER INTERNATIONAL INC LTD, Nicosia (CY)

( * ) Notice: Subject to any disclaimer, the term of this patent is extended or adjusted under 35 U.S.C. 154(b) by 580 days.

(21) Appl. No.: 17/058,894

(22) PCT Filed: Jun. 1, 2018

(86) PCT No.: PCT/EP2018/064455
§ 371 (c)(1),
(2) Date: Nov. 25, 2020

(87) PCT Pub. No.: WO2019/228640
PCT Pub. Date: Dec. 5, 2019

(65) Prior Publication Data

US 2021/0153702 A1 May 27, 2021

(51) Int. Cl.
*A47K 10/48* (2006.01)

(52) U.S. Cl.
CPC ..... *A47K 10/48* (2013.01)

(58) Field of Classification Search
CPC ..... A47K 10/48
USPC ..... 34/202
See application file for complete search history.

(56) References Cited

U.S. PATENT DOCUMENTS 1,651,636 A * 12/1927 Shaughnessy ..... F23G 5/00 110/118
2,853,591 A * 9/1958 Fine ..... A47K 10/48 219/512
3,122,428 A * 2/1964 Wiedermann ..... F26B 17/288 34/115
3,559,298 A * 2/1971 Theilemann et al. .. F26B 21/00 415/53.3

(Continued)

FOREIGN PATENT DOCUMENTS

DE 18 62 188 U 11/1962
EP 1839546 B1 * 8/2016 ..... A47K 10/48

(Continued)

*Primary Examiner* — Stephen M Gravini
(74) *Attorney, Agent, or Firm* — ASLAN LAW, P.C.

(57) ABSTRACT

A hand dryer, suitable for anchoring to a wall, the hand dryer comprising a housing that is equipped inside with a pump configured to deliver air downward; an electronic unit configured to control the functioning of the dryer; an axial-flow pump oriented vertically inside the housing; a convergent nozzle configured for channeling and accelerating air, delivered by the axial-flow pump, from an upper air intake opening to a lower outlet opening, wherein said convergent nozzle is aligned coaxially and is in the vertical direction with the axial-flow pump; and at least one air outlet nozzle end mounted on the lower opening of the convergent nozzle, and which has a surface opposite the direction of the circulation of the air, equipped with at least one opening with a cross-section that narrows in the direction of the air outlet and that causes an additional acceleration of the air driven through the convergent nozzle to the outlet opening with a low noise level.

20 Claims, 3 Drawing Sheets

(56) References Cited

U.S. PATENT DOCUMENTS

| | | | | | |
|---|---|---|---|---|---|
| 4,019,260 | A | | 4/1977 | Levy et al. | |
| 4,594,797 | A | * | 6/1986 | Houck, Jr. | A01K 13/001 34/233 |
| 4,817,301 | A | * | 4/1989 | Belanger | B60S 3/002 34/233 |
| 6,038,786 | A | * | 3/2000 | Aisenberg | A47K 10/48 34/267 |
| 6,085,435 | A | | 7/2000 | Russi | |
| 7,555,209 | B2 | * | 6/2009 | Pradas Diez | A47K 10/48 34/205 |
| 11,553,822 | B2 | * | 1/2023 | Yoo | A47K 10/48 |
| 2010/0192399 | A1 | | 8/2010 | Sawabe | |
| 2014/0165418 | A1 | * | 6/2014 | Smith | A47K 10/48 34/227 |
| 2021/0153702 | A1 | * | 5/2021 | Rafael | A47K 10/48 |

FOREIGN PATENT DOCUMENTS

| | | | | | |
|---|---|---|---|---|---|
| ES | 8901389 | | | 4/1989 | |
| FR | 2 312 990 | A1 | | 12/1976 | |
| GB | 337 369 | A | | 10/1930 | |
| GB | 909069 | A | * | 10/1962 | |
| WO | WO-2019228640 | A1 | * | 12/2019 | A47K 10/48 |

* cited by examiner

HAND DRYER

CROSS-REFERENCE TO RELATED APPLICATIONS

This application is a National Stage Entry of PCT/EP2018/064455 filed on Jun. 1, 2018. This application claims priority to PCT Application No. PCT/EP2018/064455 filed on Jun. 1, 2018, the entire contents of which are hereby incorporated by reference.

OBJECT OF THE INVENTION

The object of the invention is a hand dryer of the type intended for anchoring to a wall and that comprise a housing that is equipped inside with an electrically-driven pump, responsible for delivering air towards a lower outlet in order to project it onto the hands of the user and facilitate drying; with said dryer incorporating an electronic unit to control the functioning of the dryer.

This hand dryer has several characteristics aimed at providing a series of functional advantages in regard to the acceleration of the air supplied by the pump during its circulation through the inside of the dryer, to guarantee a high discharge speed with a low level of noise and the possibility of increasing the versatility of the dryer by means of the replacement of several air outlet nozzle ends.

FIELD OF APPLICATION THE INVENTION

This invention is applicable in the sector dedicated to the manufacture of hand dryers.

STATE OF THE ART

There are currently different types of hand dryers existing on the market, with the ones most similar to the invention being wall dryers, which are equipped with a housing to contain a pump driven by an electric motor and that delivers air towards an outlet grate positioned at the bottom of the housing.

This type of hand dryer, as described for example in utility model U8901389, are equipped with a centrifugal pump and the air projected tangentially by means of said pump must be redirected by the inside of the housing towards the outlet grate, which causes considerable loss of load.

To obtain a large flow of air to the outlet of the dryer and to reduce the drying time of hands, the power of the electric motor responsible for driving the pump must be increased proportionally. This solution increases the noise generated by the dryer while it is in operation.

These conditioning factors mean that the user must choose between a powerful dryer, which minimizes drying time and generates a significant level of noise, or a dryer with less power and less noise, but that considerably increases the drying time of the hands.

The applicant of the invention is not aware of the existence of hand dryers, of the aforementioned type, that satisfactorily resolve the problems described and that have characteristics similar to those of the hand dryer of the present invention.

DESCRIPTION OF THE INVENTION

The hand dryer of the invention, comprising a housing that is equipped inside with a pump that delivers the air in the downward direction and an electronic unit for the control of the functioning of the dryer, has several technical characteristics that provide a series of functional advantages, in regard to the acceleration of the air supplied by the pump during its circulation inside the dryer, as well as to guarantee a high air outlet speed with a low level of noise.

This invention also includes the possibility of increasing the versatility of the dryer by means of the substitution of several air outlet nozzle ends.

To achieve this, and according to the invention, this hand dryer comprises:

- an axial-flow pump oriented vertically inside the housing;
- a convergent nozzle for channeling and accelerating the air, pushed by the axial-flow pump towards a lower outlet opening; with said convergent nozzle aligned coaxially and in the vertical direction with the axial-flow pump and;
- at least one air outlet nozzle end that can be attached to the lower opening of the convergent nozzle, and which has a surface opposite the direction of the circulation of the air and that has at least one opening with a cross-section that narrows in the direction of the air outlet, which causes an additional acceleration of the air carried by the convergent nozzle to the outlet opening.

In one embodiment of the invention, the convergent nozzle comprises several substantially vertical fins distributed radially on the inside of the convergent nozzle and that laterally define a series of air conduit sectors towards the lower outlet opening.

The vertically aligned arrangement of the axial flow pump, of the convergent nozzle, and the opening or openings of the outlet nozzle end minimizes the loss of load of the air supplied by the pump; in addition, the convergent configuration, or decreasing cross-section, of both the convergent nozzle as well as the opening or openings of the outlet nozzle end in the direction of the air flow, provides a double acceleration of the air in its path towards the outside of the dryer, with the dryer supplying air at high speed with a low level of noise, which reduces the time required to dry the hands of the user.

As described in the claims, the dryer may be equipped with an outlet nozzle end, with a particular configuration, permanently attached to the outlet opening of the convergent nozzle; or with several interchangeable nozzle ends with one or more openings with different configurations, which gives the dryer greater versatility, because depending on the configuration and the number of openings of the nozzle end, the dryer can supply one or several streams of air, with a higher or lower outlet speed.

In the second case, the air outlet nozzle end and the outlet opening of the convergent nozzle comprise several complementary means for their removable connection.

These and other characteristics of the invention, described in the attached claims, will be more easily understood in light of the exemplary embodiments shown in the attached figures.

DESCRIPTION OF THE FIGURES

To complement the description that is being provided and in order to provide a better understanding of the characteristics of the invention, a set of drawings is included along with this descriptive summary, in which the following elements have been represented for the purposes of illustration but not limitation.

PREFERRED EMBODIMENT OF THE INVENTION

Figure 1:
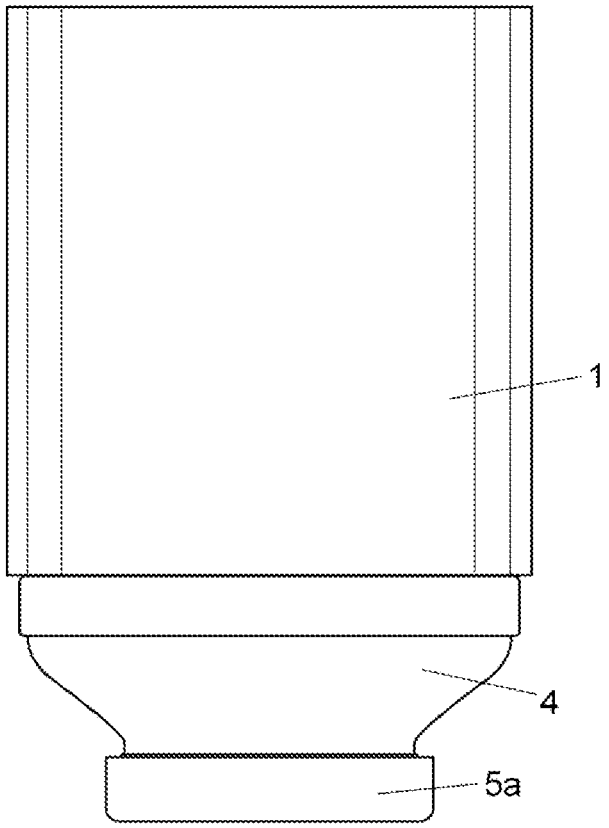
FIG. 1 shows an elevation view of an exemplary embodiment of the hand dryer according to the invention.
Figure 2:
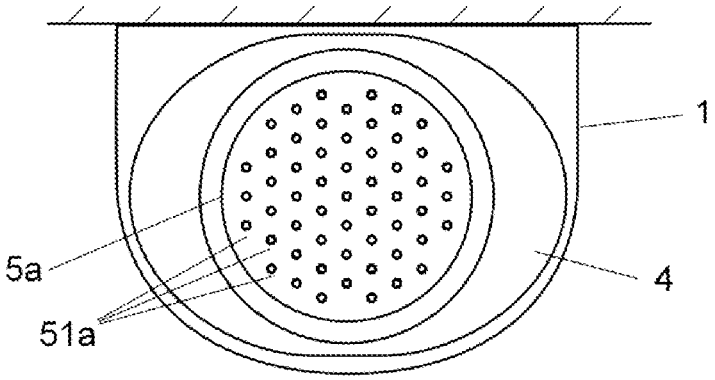
FIG. 2 shows a schematic plan view from below of the dryer in the previous figure.
Figure 3:
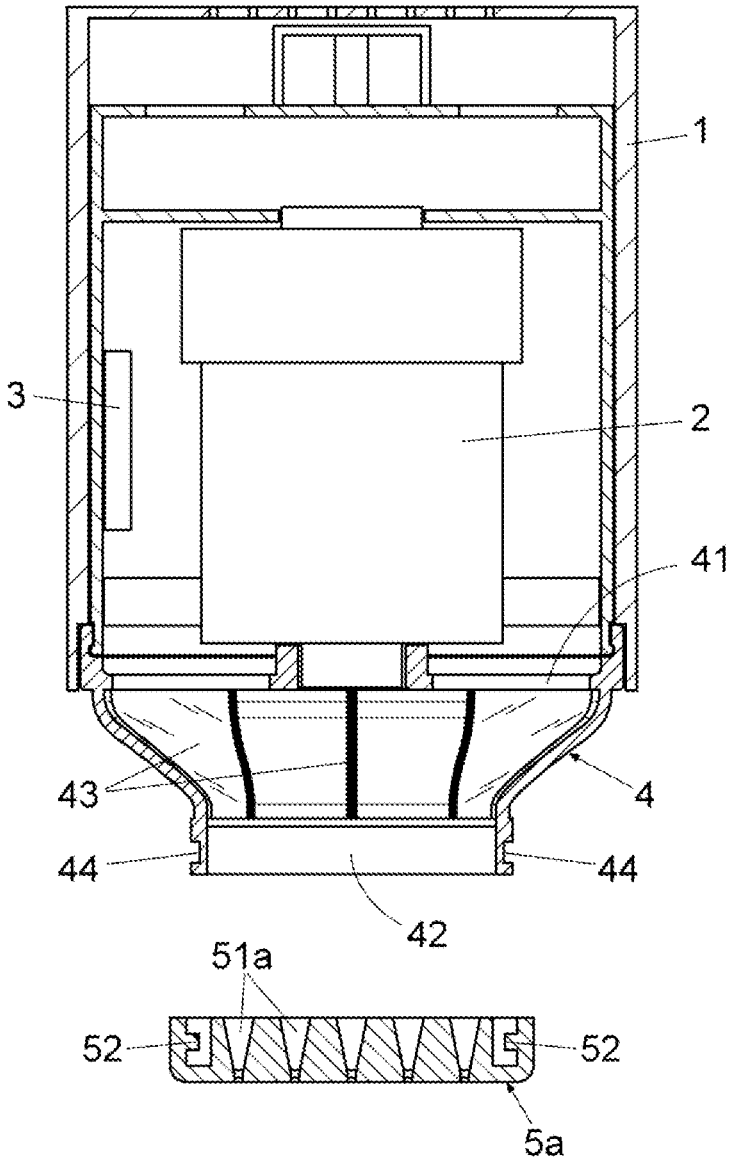
FIG. 3 shows an elevation view of the hand dryer in FIG. 1, in a vertical cross-section, and with the air outlet nozzle end removed from the lower opening of the convergent nozzle.

The hand dryer shown in FIGS. 1 to 3 comprises a housing (1) that is equipped inside with a vertically-oriented axial-flow pump (2) pump that delivers air downward and an electronic unit (3) to control the functioning of the dryer.

The activation and deactivation of the pump (2) may be done automatically by means of a presence sensor; semi-automatically by means of an activation switch operated manually and a shutdown timer; or by any other conventional means.

The dryer comprises a convergent nozzle (4) equipped with an upper opening (41) for the intake of air supplied by the pump (2) and a lower opening (42) to discharge the air with a low level of noise.

Said convergent nozzle (4) is vertically aligned with the axial-flow pump and channels and accelerates the air delivered by the pump (2), towards the lower opening (42).

The dryer also comprises at least one air outlet nozzle end that can be attached to the lower opening of the convergent nozzle (4), as shown in FIG. 1, and which has a surface opposite the direction of the circulation of the air and that has at least one opening with a cross-section that narrows in the direction of the air outlet, which causes an additional acceleration of the air carried by the convergent nozzle to the outlet opening.

Figure 4:
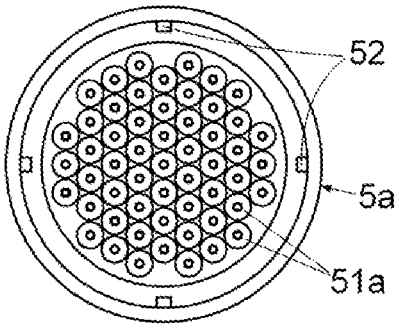
FIGS. 4 and 5 show, respectively, a plan view from above and an elevation view, in a vertical cross-section, of a first exemplary embodiment of the air outlet nozzle end.
Figure 5:
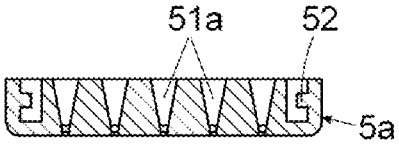

In a first embodiment of the invention shown in FIGS. 3, 4, and 5, the air outlet nozzle end (5*a*) has a plurality of convergent openings (51*a*) with a cross-section that narrows in the direction of the discharge of the air in the surface opposite the direction of the circulation of the air, equipped with an upper intake opening and a lower air outlet opening.

The air intake openings of the convergent openings (51*a*) are in contact with or very close to each other and occupy at least 60% of the surface area of the nozzle end opposite the direction of the circulation of the air. This characteristic minimizes the loss of load as a result of the impact of the supplied air against the upper surface of the nozzle end (5*a*), because most of the air flow directly enters the aforementioned convergent openings (51*a*).

With this nozzle end (5*a*), the hand dryer provides a plurality of fine streams of air at high speed, with a high capacity for drying hands.

Figure 6:
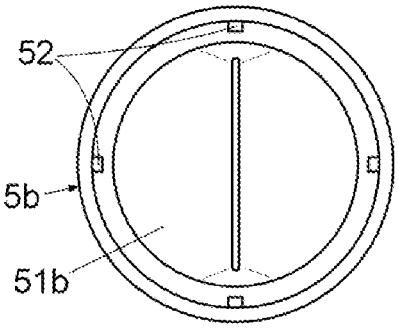
FIGS. 6 and 7 show, respectively, a plan view from above and an elevation view, in a vertical cross-section, of a second exemplary embodiment of the air outlet nozzle end.
Figure 7:
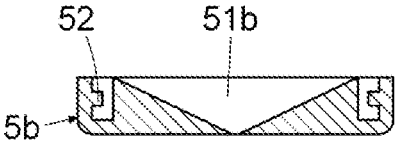
Figure 8:
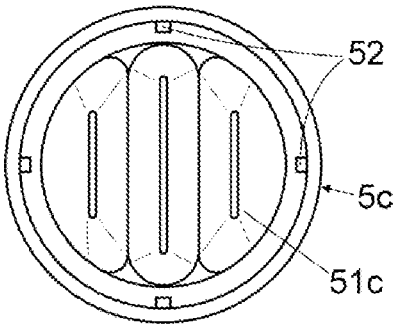
FIGS. 8 and 9 show, respectively, a plan view from above and an elevation view, in a vertical cross-section, of a third exemplary embodiment of the air outlet nozzle end.
Figure 9:
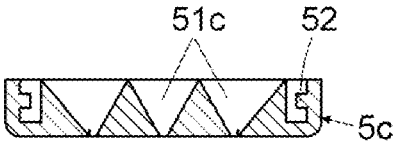

FIGS. 6 and 7 show a second embodiment of the air outlet nozzle end (5*b*) that has an elongated opening (51*b*) on the surface opposite the direction of the circulation of the air, acting as a slot, with a cross-section that narrows in the direction of the circulation of the air.

With this nozzle end (5*a*), the dryer provides a curtain of air for drying hands, at a lower speed than with the nozzle end (5*a*) and with a very low noise level.

FIGS. 6 and 7 show a third embodiment of the air outlet nozzle end (5*c*) that has several elongated openings (51*c*) on the surface opposite the direction of the circulation of the air, acting as a slot, with a cross-section that narrows in the direction of the circulation of the air.

With this nozzle end (5*b*), the dryer provides several parallel curtains of air for drying hands.

As mentioned before, the dryer may be equipped with a particular nozzle end (5*a*, 5*b*, 5*c*) attached permanently to the outlet opening (42) of the convergent nozzle, although in the exemplary embodiment shown, the air outlet nozzle ends (5*a*, 5*b*, 5*c*) and the outlet opening (42) of the convergent nozzle (4) comprise several complementary means (52, 42) for their removable connection. In this case, said complementary means (52, 42) are represented by several nipples (52) and several L-shaped channels (42), making up a bayonet coupling.

In the example shown in FIG. 3, the convergent nozzle (4) comprises several substantially vertical fins (43) distributed radially on the inside of the convergent nozzle and that laterally define a series of air conduit sectors towards the lower outlet opening (42).

Having sufficiently described the nature of the invention, as well as a preferred embodiment, it is hereby stated for the pertinent purposes that the materials, shape, size, and arrangement of the described elements may be modified, provided that this does not alter the essential characteristics of the invention that is claimed below.

The invention claimed is:

1. A hand dryer, suitable for anchoring to a wall, the hand dryer comprising:

a housing that is equipped inside with a pump configured to deliver air downward;

an electronic unit configured to control the functioning of the dryer;

an axial-flow pump oriented vertically inside the housing;

a convergent nozzle configured for channeling and accelerating air, delivered by the axial-flow pump, from an upper air intake opening to a lower outlet opening, wherein said convergent nozzle is aligned coaxially and is in the vertical direction with the axial-flow pump; and at least one air outlet nozzle end mounted on the lower opening of the convergent nozzle, and which has a surface opposite the direction of the circulation of the air, equipped with at least one opening with a cross-section that narrows in the direction of the air outlet and that causes an additional acceleration of the air driven through the convergent nozzle to the outlet opening with a low noise level.

2. The hand dryer according to claim 1, wherein the air outlet nozzle end has a plurality of convergent openings on the surface opposite the direction of the circulation of the air, with a cross-section that narrows in the direction of the air outlet, equipped with an intake opening and an air outlet opening.

3. The hand dryer according to claim 2, wherein the air intake openings of the convergent openings are in contact with or very close to each other and occupy at least 60% of the surface area of the nozzle end opposite the direction of the circulation of the air.

4. The hand dryer according to claim 1, wherein the air outlet nozzle end has an elongated opening on the surface opposite the direction of the circulation of the air, acting as a slot, with a cross-section that narrows in the direction of the circulation of the air.

5. The hand dryer according to claim 1, wherein the air outlet nozzle end has several elongated openings on the surface opposite the direction of the circulation of the air, acting as a slot, with a cross-section that narrows in the direction of the circulation of the air.

6. The hand dryer according to claim 1, wherein the nozzle end is permanently attached to the outlet opening of the convergent nozzle.

7. The hand dryer according to claim 1, wherein the air outlet nozzle end and the outlet opening of the convergent nozzle comprise several complementary means for their removable connection.

8. The hand dryer according to claim 1, wherein the convergent nozzle comprises several substantially vertical fins inside, distributed radially and that laterally define a series of air conduit sectors towards the outlet opening.

9. The hand dryer according to claim 2, wherein the nozzle end is permanently attached to the outlet opening of the convergent nozzle.

10. The hand dryer according to claim 3, wherein the nozzle end is permanently attached to the outlet opening of the convergent nozzle.

11. The hand dryer according to claim 4, wherein the nozzle end is permanently attached to the outlet opening of the convergent nozzle.

12. The hand dryer according to claim 5, wherein the nozzle end is permanently attached to the outlet opening of the convergent nozzle.

13. The hand dryer according to claim 2, wherein the air outlet nozzle end and the outlet opening of the convergent nozzle comprise several complementary means for their removable connection.

14. The hand dryer according to claim 3, wherein the air outlet nozzle end and the outlet opening of the convergent nozzle comprise several complementary means for their removable connection.

15. The hand dryer according to claim 4, wherein the air outlet nozzle end and the outlet opening of the convergent nozzle comprise several complementary means for their removable connection.

16. The hand dryer according to claim 5, wherein the air outlet nozzle end and the outlet opening of the convergent nozzle comprise several complementary means for their removable connection.

17. The hand dryer according to claim 2, wherein the convergent nozzle comprises several substantially vertical fins inside, distributed radially and that laterally define a series of air conduit sectors towards the outlet opening.

18. The hand dryer according to claim 3, wherein the convergent nozzle comprises several substantially vertical fins inside, distributed radially and that laterally define a series of air conduit sectors towards the outlet opening.

19. The hand dryer according to claim 4, wherein the convergent nozzle comprises several substantially vertical fins inside, distributed radially and that laterally define a series of air conduit sectors towards the outlet opening.

20. The hand dryer according to claim 5, wherein the convergent nozzle comprises several substantially vertical fins inside, distributed radially and that laterally define a series of air conduit sectors towards the outlet opening.

* * * * *